US006508667B1

(12) United States Patent
Nien

(10) Patent No.: US 6,508,667 B1
(45) Date of Patent: Jan. 21, 2003

(54) BACK PLATE WITH A GROUNDING MEMBER FOR AN ELECTRIC APPARATUS

(75) Inventor: Shu-Li Nien, Hsintien (TW)

(73) Assignee: Chou Chin Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/072,932

(22) Filed: Feb. 12, 2002

(51) Int. Cl.[7] ..... H01R 13/73
(52) U.S. Cl. ..... 439/553; 439/939
(58) Field of Search ..... 439/553, 95, 101, 439/939, 97, 607–610, 92

(56) References Cited

U.S. PATENT DOCUMENTS 4,883,433 A * 11/1989 Lane ..... 439/607
4,990,094 A * 2/1991 Chandler et al. ..... 439/108
5,161,997 A * 11/1992 Defibaugh et al. ..... 439/532
6,083,041 A * 7/2000 Kuo ..... 439/553
6,095,855 A * 8/2000 Iwata et al. ..... 439/553
6,206,731 B1 * 3/2001 Kuo ..... 439/610
6,231,385 B1 * 5/2001 Kuo ..... 439/557

* cited by examiner

*Primary Examiner*—Gary Paumen
*Assistant Examiner*—Ross Gushi
(74) *Attorney, Agent, or Firm*—Rabin & Berdo, P.C.

(57) ABSTRACT

A back plate has a metal body with at least one through hole defined in the body. A grounding member formed on one edge of each through hole. The grounding member has a straight long portion, a short portion and an arcuate portion. The long portion with a first end leads from the periphery of the at least one through hole. The short portion with a first end separates from the periphery of the at least one through hole and is formed substantially in line with the long portion. The first end of the short portion is directed towards a central portion of the at least one through hole. The arcuate portion extends between second ends of the long and short portions. Accordingly, the grounding member can reliably contact with the casing of the connector due to the resilience provided by the grounding member.

2 Claims, 4 Drawing Sheets

BACK PLATE WITH A GROUNDING MEMBER FOR AN ELECTRIC APPARATUS

BACKGROUND OF THE INVENTION

1. Field of the Invention

The present invention relates to a back plate, and more particularly to a back plate for an electrical apparatus and having grounding members to obviate the interference of electromagnetic waves.

2. Description of Related Art

An electrical apparatus such as a computer generally comprises a casing and multiple electrical elements mounted in the casing to achieve desired functions in the cooperation of the electrical elements. To connect the electrical apparatus with other apparatus, connectors are mounted on the electrical apparatus to transport signals between different apparatuses through wires or cords. The connectors are mounted on a back plate of the casing of the electrical apparatus. With reference to FIGS. 4 to 6, the conventional back plate (40) for an electrical apparatus in accordance with the prior art comprises a metal body. The body is attached to the casing of the electrical apparatus with fasteners such as bolts. Multiple through holes (42) are defined in the back plate (40) for receiving the connectors (20). To prevent the transported signal from being interfered by electromagnetic waves, the connectors (20) are grounded. Because the body of the back plate (40) is made of a metal material, the connectors (20) are always directly grounded to the back plate (40) on which the connectors (20) are mounted. A grounding member (44) is mounted on an edge of the through hole (42) in the back plate (40). The conventional grounding member (44) is a tab integrally formed on an edge of the through hole (42) in the back plate (40). When the connector (20) is inserted into the through hole (42), the casing of the connector (20) will abut the grounding member (44). The back plate (20) can serve as a ground to the connector (20).

However, the conventional grounding member (44) does not have any resiliency relative to the back plate (40). The grounding member (44) is easily pushed away from a position contacting with casing of the connector (20) during the period of assembling the connector (20) to the through hole (42), thus the grounding effect to the connector (20) will be lost. That loss means distortion of the signal transported by the connector (20) easily occurs due to the interference of the electromagnetic waves.

To overcome the shortcomings, the present invention tends to provide a back plate to mitigate or obviate the aforementioned problems.

SUMMARY OF THE INVENTION

The main objective of the invention is to provide a back plate for an electrical apparatus and having a grounding member that can reliably contact with the casing of a connector. The back plate has a metal body with at least one through hole defined in the body. A grounding member formed on one edge of each through hole. The grounding member has a straight long portion, a short portion and an arcuate portion. The long portion with a first end leads from the periphery of the at least one through hole. The short portion with a first end separates from the periphery of the at least one through hole and is formed substantially in line with the long portion. The first end of the short portion is directed towards a central portion of the at least one through hole. The arcuate portion extends between second ends of the long and short portions. With such a grounding member, the short portion can reliably contact with the casing of the connector due to the resilience provided by the grounding member.

Other objects, advantages and novel features of the invention will become more apparent from the following detailed description when taken in conjunction with the accompanying drawings.

DETAILED DESCRIPTION OF PREFERRED EMBODIMENT

Figure 1:
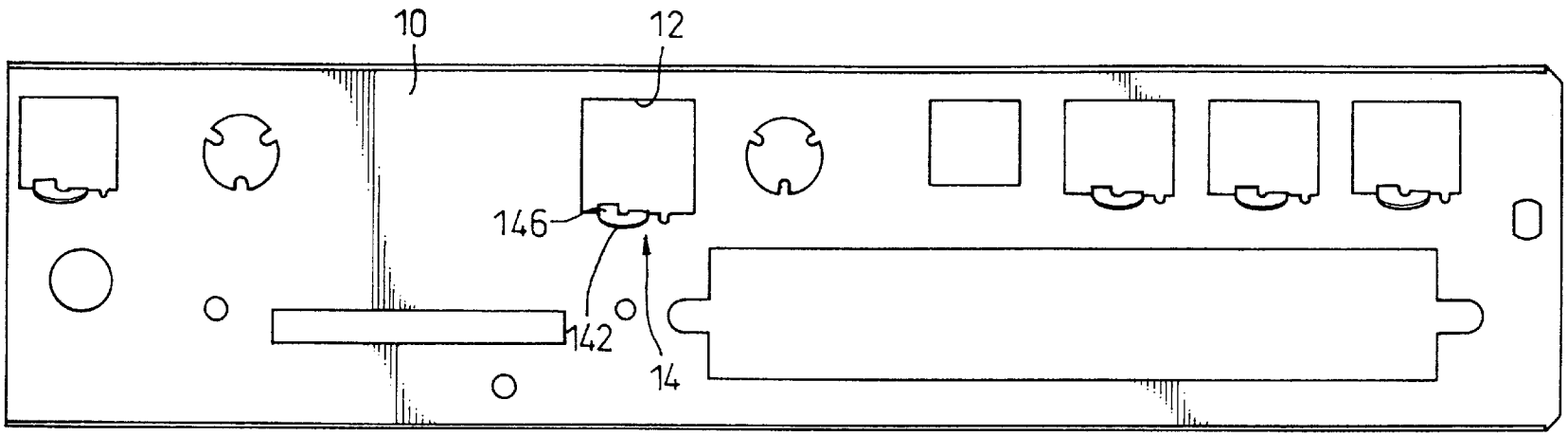
FIG. 1 is a plan view of a back plate for an electrical apparatus in accordance with the present invention.
Figure 5:
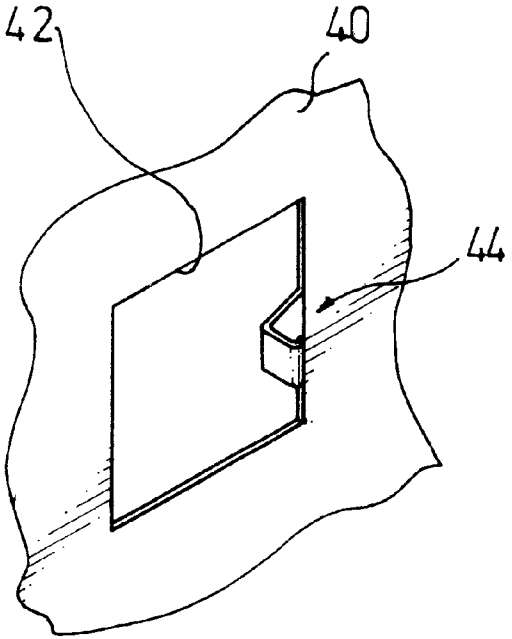
FIG.5 PRIOR ART
FIG. 5 is partial perspective of the conventional back plate in FIG. 4.
Figure 2:
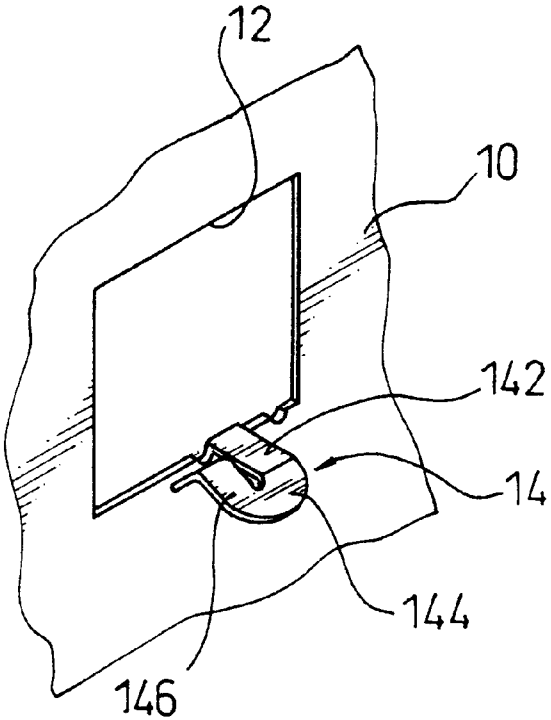
FIG. 2 is a partial perspective view of the back plate in FIG. 1.
Figure 6:
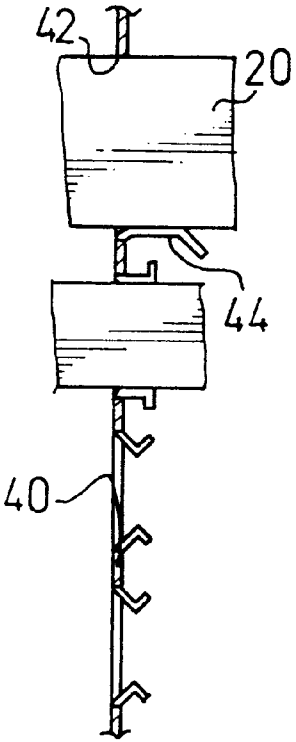
FIG.6 PRIOR ART
FIG. 6 is a side plan view in partial cross section of the conventional back plate in FIG. 4 with connectors.
Figure 3:
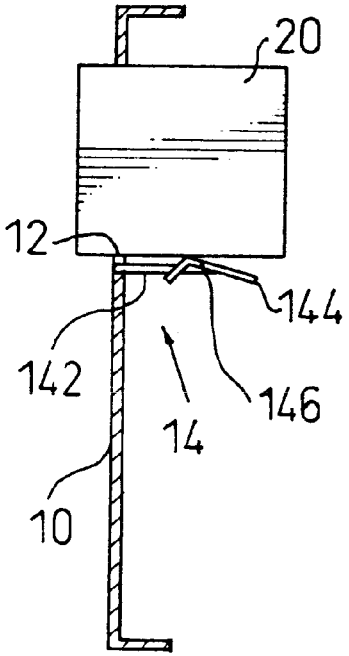
FIG. 3 is a side plan view in partial cross section of the back plate in FIG. 1 with a connector.
Figure 4:
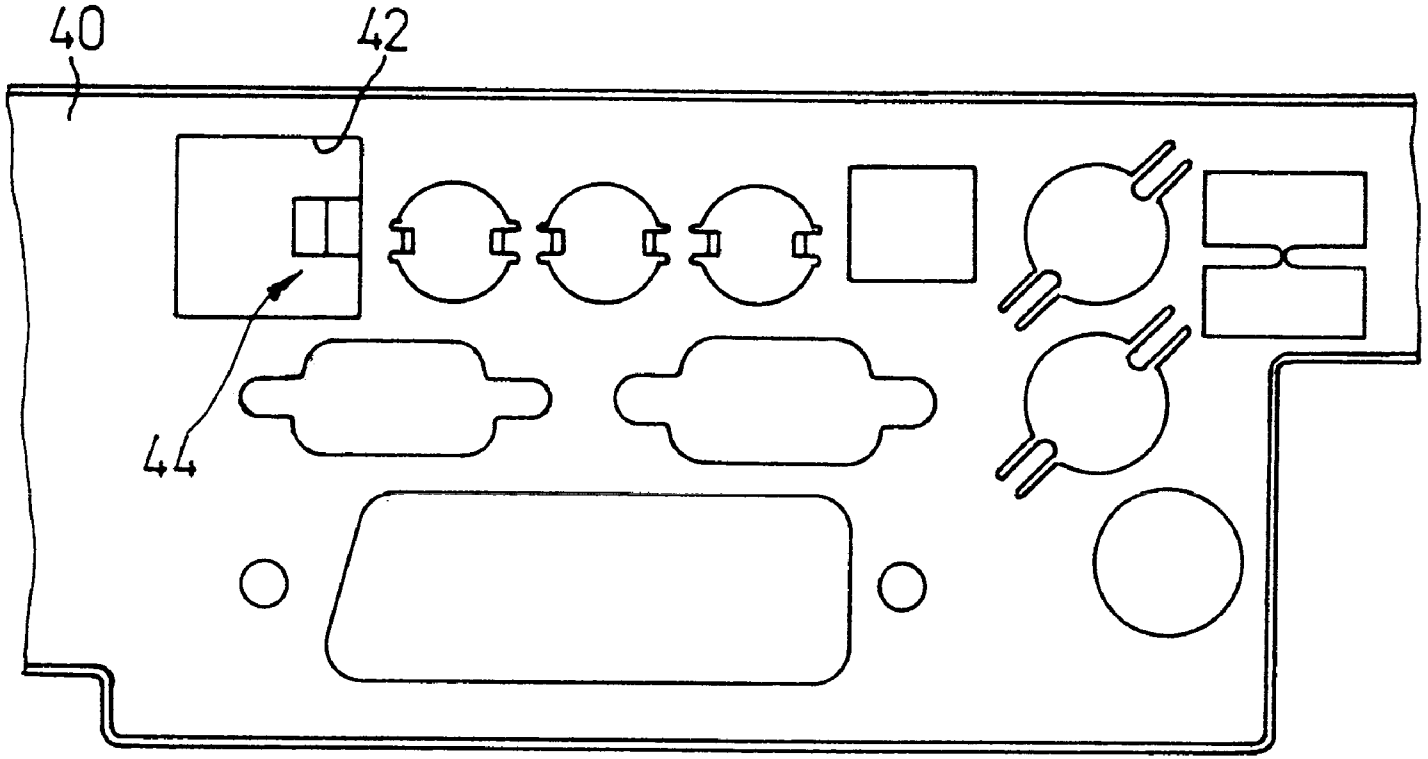
FIG. 4 PRIOR ART
FIG. 4 is a partial plan view of a conventional back plate for an electrical apparatus in accordance with the prior art.

With reference to FIGS. 1 to 3, a back plate (10) with a grounding member (14) has at least one through hole (12) to receive therethrough a connector (20). The back plate (10) is made of metal sheet or an electrically conductive sheet. A periphery defines the through hole (12) and is configured accordingly to mate with the connector (20). A J-shaped tongue (14) extends integrally and perpendicularly outward from the periphery of the through hole (12). The tongue (14) has a straight long portion (142) with a first end leading from the periphery of the through hole (12), a V-shaped short portion (146) with a first end separate from the periphery of the hole (12) and formed substantially in line with the long portion (142), and an arcuate portion (144) extending between second ends of the long and short portions (142, 146). The first end of the short portion (146) is directed towards a central portion of the through hole (12). Because the second end of the short straight portion (146) is not directly connected to the back plate (10), the tongue (14) has a resiliency relative to the back plate (10). The first end of the short portion (146) provides a guiding effect to the connector (20) when the connector (20) is inserted into the through hole and thus avoids the connector (20) being blocked by the short portion (146).

With reference to FIGS. 2 and 3, because the tongue (14) has a resiliency relative to the back plate (10) and the short portion (146) extends toward the center of the through hole (12), the short portion (146) can be forced to contact with the casing of the connector (20). This can ensure that the grounding member (14) reliably contacts with the casing of the connector (20) to provide a grounding effect to the connector (20). The distortion of the signal transported by the connector (20) is avoided.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A back plate for be mounted to a casing of an electric apparatus comprising:

a metal body;

at least one through hole defined in the body and adapted for a connector mounted in the at least one through hole;

a grounding member extending integrally and perpendicularly outward from a periphery of the at least one through hole and having:

a straight long portion with a first end leading from the periphery of the at least one through hole;

a short portion with a first end separated from the periphery of the at least one through hole and formed substantially parallel with the long portion, and the first end of the short portion directed towards a central portion of the at least one through hole; and an arcuate portion extending between second ends of the long and short portions.

2. The back plate as claimed in claim 1, wherein the short portion of the grounding member is V-shaped so as to provide a guiding effect to the connector when the connector is inserted into the at least one through hole.

* * * * *